US010706694B2

(12) United States Patent
Allison et al.

(10) Patent No.: US 10,706,694 B2
(45) Date of Patent: Jul. 7, 2020

(54) SECURITY/TETHER CABLE

(75) Inventors: Thaine Allison, Hillsboro, OR (US); Donald Niderost, Hillsboro, OR (US); Ron Peters, Hillsboro, OR (US)

(73) Assignee: Mobile Tech, Inc., Hillsboro, OR (US)

( * ) Notice: Subject to any disclaimer, the term of this patent is extended or adjusted under 35 U.S.C. 154(b) by 0 days.

(21) Appl. No.: 13/332,877

(22) Filed: Dec. 21, 2011

(65) Prior Publication Data

US 2013/0161054 A1 Jun. 27, 2013

(51) Int. Cl.

| | |
|---|---|
| ***H01B 7/06*** | (2006.01) |
| ***G08B 13/14*** | (2006.01) |
| *H01B 11/10* | (2006.01) |
| *H01B 11/06* | (2006.01) |
| *H01B 7/08* | (2006.01) |
| *H01B 11/08* | (2006.01) |
| *H01B 7/04* | (2006.01) |

(52) U.S. Cl.

CPC ..... *G08B 13/1409* (2013.01); *G08B 13/1445* (2013.01); *G08B 13/1463* (2013.01); *H01B 7/041* (2013.01); *H01B 7/0892* (2013.01); *H01B 11/06* (2013.01); *H01B 11/08* (2013.01); *H01B 11/1091* (2013.01)

(58) Field of Classification Search

CPC ..... G08B 13/149; G08B 13/1409; G08B 13/1445; G08B 13/1463; H01B 11/06; H01B 11/08; H01B 11/1091; H01B 7/041; H01B 7/0892

USPC ..... 174/69, 70 R, 102 D, 108, 113 R

See application file for complete search history.

(56) References Cited

U.S. PATENT DOCUMENTS

| | | | | | |
|---|---|---|---|---|---|
| 1,730,945 | A | * | 10/1929 | Poole | H02G 11/003 15/DIG. 10 |
| 2,060,913 | A | * | 11/1936 | Weaver | H01B 7/06 174/117 F |
| 3,324,233 | A | * | 6/1967 | Bryant | 174/131 R |
| 3,813,481 | A | * | 5/1974 | Adams | H01B 5/104 174/128.1 |
| 3,816,644 | A | * | 6/1974 | Giffel et al. | 174/115 |
| 4,357,500 | A | * | 11/1982 | Nilsen | 379/441 |
| 4,384,688 | A | | 5/1983 | Smith | |
| 4,590,337 | A | | 5/1986 | Engelmore | |
| 4,719,319 | A | * | 1/1988 | Tighe, Jr. | 174/103 |
| 4,746,766 | A | * | 5/1988 | Soulard | H01R 23/662 174/106 R |
| 4,964,414 | A | * | 10/1990 | Handa | A61N 1/056 600/377 |
| 5,016,646 | A | * | 5/1991 | Gotthardt et al. | 607/122 |
| 5,119,457 | A | * | 6/1992 | Callahan | G02B 6/3817 174/79 |
| 5,146,205 | A | | 9/1992 | Keifer et al. | |
| 5,279,135 | A | * | 1/1994 | Leyden | E05B 69/006 70/18 |

(Continued)

OTHER PUBLICATIONS

"35 mm Camera Display"—Walmart Publication 1995.

(Continued)

*Primary Examiner* — Steven T Sawyer
*Assistant Examiner* — Paresh H Paghadal

(57) ABSTRACT

A power/security cord for use in a retail display includes the combination of at least one spring steel strand and at least one conductor coiled into the shape of a "curly-Q" cord. The steel strand provides a physical barrier against cutting the cord. The conductor provides wiring for power.

22 Claims, 7 Drawing Sheets

(56) References Cited

U.S. PATENT DOCUMENTS 5,315,063 A * 5/1994 Auclair ..... 174/78
5,763,836 A * 6/1998 Anastasi et al. ..... 174/92
5,834,699 A * 11/1998 Buck et al. ..... 174/113 R
5,884,403 A * 3/1999 Rogers ..... 30/296.1
6,170,775 B1 1/2001 Kovacik et al.
6,386,906 B1 5/2002 Burke
6,396,414 B1 * 5/2002 Bickford ..... H01B 7/065 174/47
6,748,707 B1 6/2004 Buchalter et al.
6,831,560 B2 12/2004 Gresset
6,896,543 B2 5/2005 Fort et al.
6,946,961 B2 9/2005 Frederiksen et al.
7,053,774 B2 5/2006 Sedon et al.
7,101,187 B1 9/2006 Deconinck et al.
7,202,417 B2 * 4/2007 Marszalek et al. ..... 174/113 R
7,209,038 B1 4/2007 Deconinck et al.
7,385,522 B2 6/2008 Belden, Jr. et al.
7,446,659 B2 11/2008 Marsilio et al.
7,522,047 B2 4/2009 Belden, Jr. et al.
7,626,500 B2 12/2009 Belden, Jr. et al.
7,724,135 B2 * 5/2010 Rapp et al. ..... 340/568.1
7,744,404 B1 6/2010 Henson et al.
7,861,501 B2 * 1/2011 Poulin ..... 53/580
8,674,833 B2 * 3/2014 Johnston et al. ..... 340/568.1
2002/0171604 A1 * 11/2002 Tadysak ..... G02B 27/017 345/8
2005/0134458 A1 * 6/2005 Leyden ..... G08B 13/1445 340/568.2
2006/0011378 A1 * 1/2006 Maeda ..... H01B 13/0006 174/128.1
2006/0053939 A1 3/2006 Basile et al.
2006/0131062 A1 * 6/2006 Bertges ..... H01B 7/223 174/128.1
2008/0142665 A1 * 6/2008 Belden et al. ..... 248/417
2008/0168806 A1 7/2008 Belden et al.
2008/0169923 A1 * 7/2008 Belden ..... A47F 7/024 340/568.3
2009/0033492 A1 * 2/2009 Rapp ..... A47F 7/024 340/568.8
2009/0173868 A1 7/2009 Fawcett et al.
2009/0211784 A1 * 8/2009 Grogl ..... H01B 7/0009 174/128.1
2011/0303816 A1 * 12/2011 Horvath ..... B65H 75/446 248/542
2011/0309928 A1 * 12/2011 Henson ..... G06F 1/1626 340/539.1
2011/0309934 A1 * 12/2011 Henson ..... G08B 13/1472 340/568.2
2012/0120571 A1 * 5/2012 Bisesti et al. ..... 361/679.01
2012/0188082 A1 * 7/2012 Berglund et al. ..... 340/568.2
2012/0299755 A1 * 11/2012 Jones ..... G08B 13/1436 340/990

OTHER PUBLICATIONS

Huseby, Inc. "Transcript of Deposition of Thaine H. Allison, III," Feb. 24, 2014, Charlotte, NC.
"Reasons for Substantial New Question of Patentability", paper issued in Control No. 96/000,007, Jan. 30, 2013.
Mike Cook, "Declaration of Mike Cook," pleading filed in Case No. 3:10-cv-392-BR, U.S. District Court (Oregon), Oct. 19, 2010.
Office Action, issued in Horvath (U.S. Appl. No. 12/802,644), dated Nov. 30, 2012.
MTI 2008 PowerPoint, "Vanguard Program" (Exhibit 1005 of Declaration of Mike Cook), pp. 1-9.
MTI, "Freedom Universal 2.0 Product Manual," (manual), Dec. 2008.
Protex International Corp., "Instructions for PowerPro Detangler," (instruction sheet, 2005, Bohemia, New York.
Protex International Corp., "Instructions for PowerPro Sensor Head," (instruction sheet), 2007, Bohemia, New York.
Protex International Corp., "PowerPro System," (instruction sheet) 2006, Bohemia, New York.
Reuters, "MTI Beings Shipping Freedom(TM) Universal 2.0 Merchandising Solution," (article), Oct. 1, 2008.
Thaine H. Allison, III, "Declaration of Thaine Allison in Support of Patent Owner's Reply to Petitioner's Opposition to Patent Owner's Motion to Amend," pleading filed in PTAB Case IPR2013-00122, Feb. 5, 2014.

* cited by examiner

SECURITY/TETHER CABLE

TECHNICAL FIELD

This invention relates to the cords that are used to tether electronic products to displays in retail locations.

BACKGROUND OF THE INVENTION

Tethered product displays have evolved in the retail market along with the evolution of technology from shoulder-carried camcorders to tablet devices and smart phones. The typical "big box" retailer has one or more display locations inside the store with an array of hand-held devices mounted to a countertop (or similar surface) at individual post positions. In some cases, the product is mounted to the post such that it cannot be lifted. More commonly, the product is tethered so that the consumer can lift the product and examine it, and thereafter, return it to rest on the countertop surface.

With respect to the latter situation, different types of tethered systems have evolved in the art. One of the more common types is a reeled, multi-conductor cable. The thin-gauge copper wires within this type of cable provide a certain degree of physical security against cutting, although primary security in this type of system involves providing electrical power to theft sensors that are triggered when power is cut. Alternatively, reeled steel cables have been used, mostly during the early beginnings of retail/hand-held security systems. This older type of system generally provides only physical security because the typical braided steel cable is difficult to cut. A third type of security/tether cable is a "curly-Q" cable, somewhat like the one that is common to older telephones and similar configurations. This last kind of cable offers extension and retraction of the cord (via the coils in the cord) without a reel. However, like the reeled, multi-conductor cable described above, it is also easy to cut because there is little more than thin-gauge copper wires inside the coils.

U.S. Pat. No. 7,592,548 describes a security cable having a central metal cord surrounded by a spiral wrap of electrical conductors. While this design combines the physical security of a steel cord with the need to have wiring inside the tether, it cannot be made to work in a "curly-Q" configuration where tether extension and retraction comes from coils that are closely spaced (i.e., like a coil spring).

The invention described here is an improvement over the types of power-security cords described above.

SUMMARY OF THE INVENTION

The invention is an improved power/security cord for use in a retail display. It includes a continuous length of spring steel next to at least one conductor that is surrounded by an exterior cord sheath. The steel provides cut-resistance but is arranged within the cord so as to provide a balance between cut resistance and flexibility.

In one embodiment, the combination of spring steel and conductor are coiled into the shape of a "curly-Q" cord with the coils of the cord providing elastic extension and retraction for respectively removing and returning displayed product (e.g., a tablet device or smart phone) to and from a retail display. As indicated, the spring steel coils provide physical security that makes it difficult to cut the cord without losing the normal extension and retraction of a curly-Q cord.

In this respect, the reader needs to bear in mind that the invention is specifically designed for use as a tether in a retail display where electronic products are sold. The tether needs to function in a situation where the consumer lifts and returns the product relative to the display during the course of handling the product (e.g., looking at particular cell phone or smartphone model the customer is interested in purchasing). Adding spring steel within a curly-Q cord structure involves altering the normal spring forces of the cord—which likewise alters the amount of "pull" that the consumer needs to put on the tether to pull the product away from the display. The spring coils need to be stiff or strong enough to return the cord to the fully retracted state—with coils tightly packed against each other. At the same time, the spring forces created via the use of steel in the cord cannot be of a magnitude such that pulling on the cord and holding the product while the cord is extended becomes noticeably difficult to the consumer. Within this balance, there needs to be sufficient thickness of the steel material so that it is difficult to cut (for security purposes). It should be noted that "spring steel" is just one of many cut resistant materials that could be used. Other metals, certain plastics, (e.g., Kevlar), etc. might be used as an alternative to increase the difficulty of cutting the security cord.

The separate conductor wire inside the coiled cord provides a means for transmitting electrical power through the cord that can be used to provide power to the hand-held or power the various kinds of security sensors that are often attached to the hand-held. The latter is conventional in that it is common to use one or more electrical conductors in a tether cable for electrically powering devices and security sensors at the same time, with the security sensors providing alarm generation means for creating an audio or visual alarm signal when the sensor is removed or the applicable conductor wire in power/security cord is cut. In the present case, the steel is included in the cord as a separate form of mechanical form of security that adds to electrical security alarm systems.

While the above implementation is described as using "spring steel" within a "curly-Q" configuration, it is to be understood that alternative implementations can be realized using other configurations of steel strands and multi-conductor combinations, described in this document. The issue involves the difficulty of combining steel wire with low gauge electrical wire in a tether designed to be used in retail security displays. The curly-Q cord is one type of known tether design, except there is no evidence in the prior art, known to applicant, that the prior art teaches how to embed steel coils in a curly-Q cord with low gauge conductor wires to create a useful tether that works for the consumer (i.e., is easy to pull and hold) but provides the retailer with desired security against theft.

It may be possible to provide the same kind of functionality in a non-curly-Q cord situation (i.e., a reeled retractor) by using a prearranged number of steel cable strands relative to a prearranged number of conductor cords within the matrix of the cord. In this respect, in one of the embodiments described below, the power/security cord could consist of a four (or less or more) conductor design that is a "non-coiled" configuration—the number of conductors corresponding to the number of electrical circuits that are desired for providing power and security at the hand-held level. The conductors are interwoven with or run parallel to thin steel strands within the cable. Striking a proper balance between steel and conductors in this type of design might allow production of a cable that can be put on a small reel, thus providing the same functionality as prior art, reeled retractors, but with the added mechanical security of steel.

Regardless of the implementation, the number and arrangement of steel strands and conductors in the cable can be tailored to meet the need for the specific retail tether implementation. In situations where an even larger number of conductors is desired (e.g., six conductors as an example), it may be desirable to include some type of central filler core.

According to yet another aspect of the design described here, and regardless of the specific power/security cord implementation (i.e., coiled or non-coiled) the conductors need protection against strain relief, which is now provided by the steel that is embedded in the cord. In other words, it is typical to use RJ12 connectors at each end of a power/security cord for easily connecting or disconnecting the cord to and from electrical boards in mounting platforms or other types of mounting devices. As indicated above, the power/security cord is usually designed to permit a consumer to lift a hand-held from a retail display surface, examine it, and then return it to the display. The forces acting on the cord during these movements will place significant strain on the typical RJ12 connector (or other kinds of wire-to-wire connections)—which can cause electrical problems and/or malfunctions in the security system. In accordance with the invention, therefore, adding steel to the cord enables using the ends of the steel strands to provide strain relief in a security tether in the retail market. As will become apparent from the following description, this is accomplished by capturing the ends of the steel cable independently from the electrical end connections of the cable.

The foregoing summary will become more clear upon review of the following detailed description, which is to be taken in conjunction with the drawings.

BRIEF DESCRIPTION OF THE DRAWINGS

In the drawings, like reference numerals and letters refer to like parts throughout the various views, and wherein.

DETAILED DESCRIPTION

Figure 1:
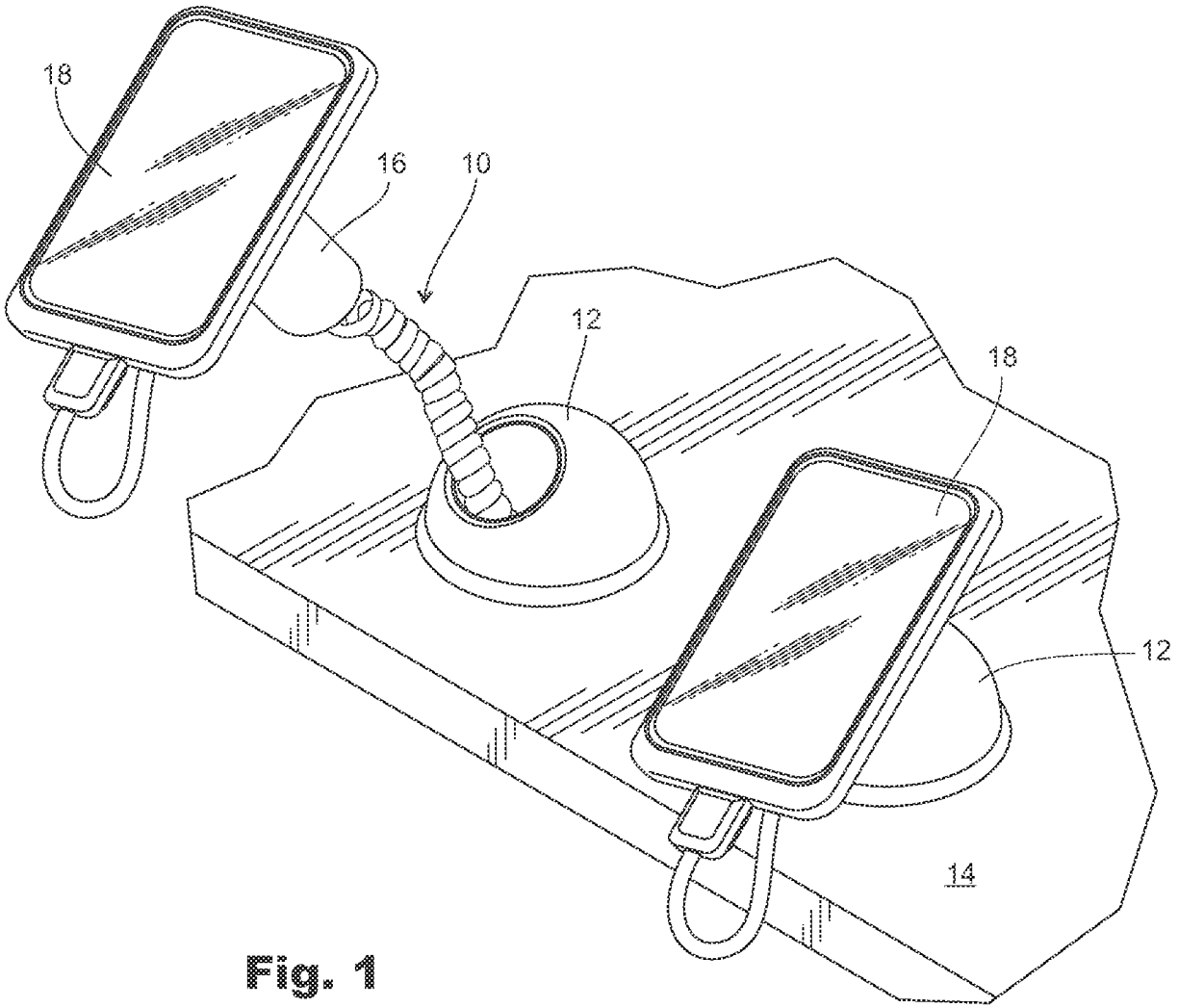
FIG. 1 is a pictorial view of a coiled power/security cord in accordance with the invention.

Referring now to the drawings, and first to FIG. 1, shown generally at 10 is an improved power/security cord constructed in accordance with one embodiment. The cord 10 shown in FIG. 1 extends out from a countertop housing 12 mounted to a top surface 14 of a display countertop. The cord 10 connects under-the-counter electronics to a mounting member 16 that is attached to a smart phone or similar electronic hand-held device 18. On the right-hand side of FIG. 1, the hand-held 18 is shown returned to a resting position on part 12.

Figure 2:
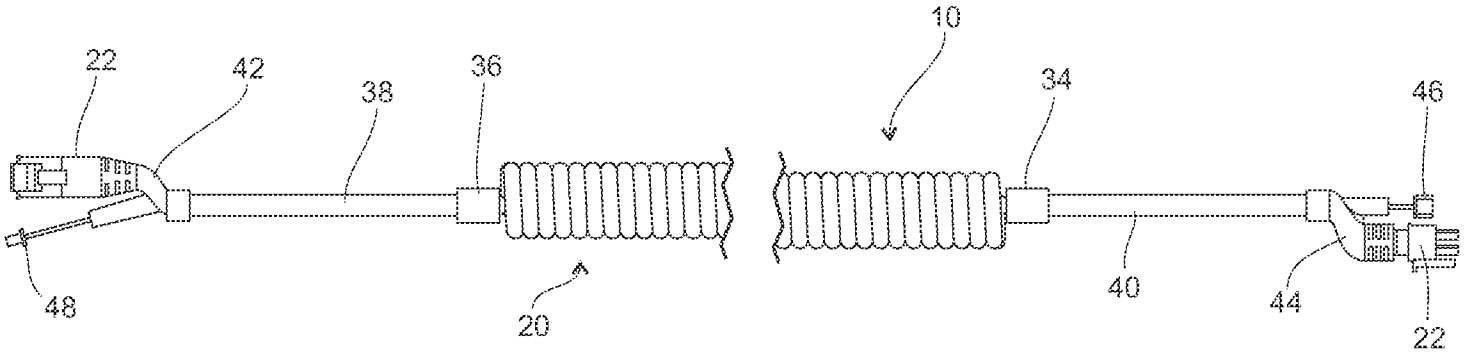
FIG. 2 is a side view of the coiled power/security cord in accordance with the invention.

Referring now to FIG. 2, the general construction of the power/security cord 10 will now be described. Outwardly, this embodiment takes the form of a "curly-Q" cord having a multiple number of coils (the coils are "tight" when cord 10 is relaxed), as indicated generally at 20. Overall, looking at the outside, this general construction would be familiar. The specific construction details that are different (the interior of the cord and strain relief features) are discussed below.

Figure 6:
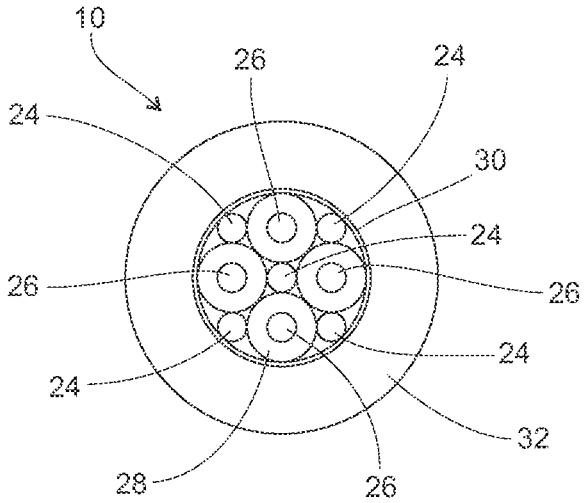
FIG. 6 is a cross-sectional view of coiled or non-coiled versions of the power/security cord in accordance with the invention

Each end of the power/security cord 10 has a conventional electrical connector 22 (e.g., RJ12 connector) which would be familiar to a person skilled in the art. Directing attention briefly to FIG. 6 (a cross-sectional view of cord 10), the interior of the cord 10 consists of a number of spring steel strands, each one of which is indicated by numeral 24. Also inside the FIG. 6 embodiment are a plurality of conductors (wires), each one indicated by numeral 26. Each conductor 26 is surrounded by its own insulation 28.

The combination of steel strands 24 and conductors 26 are collectively surrounded by a thin sheath 30; which is further surrounded by an exterior sheath 32. This interior configuration represents the span between the opposite ends 22 of the cord 10 shown in FIG. 2, including the coiled portion 20.

Turning to FIG. 2, the coiled portion 20 is terminated on each end by conventional ABS wire clips 34, 36. Outwardly of the coiled portions are non-coiled (straight) portions 38, 40, respectively. These portions 38, 40 terminate in molded fittings 42, 44 that lead to end connectors 22. While described as "straight" it is to be understood that these portions are not necessarily "stiff." They are flexible.

The steel strands 24 inside the coils 20 continue through the straight portions 38, 40 and exit, with each end terminated by a brass ferrule and washer fitting 46, 48. This arrangement relieves the strain on the electrical end connectors 22 that are branched away from ferrule/washer 46, 48.

Figure 8:
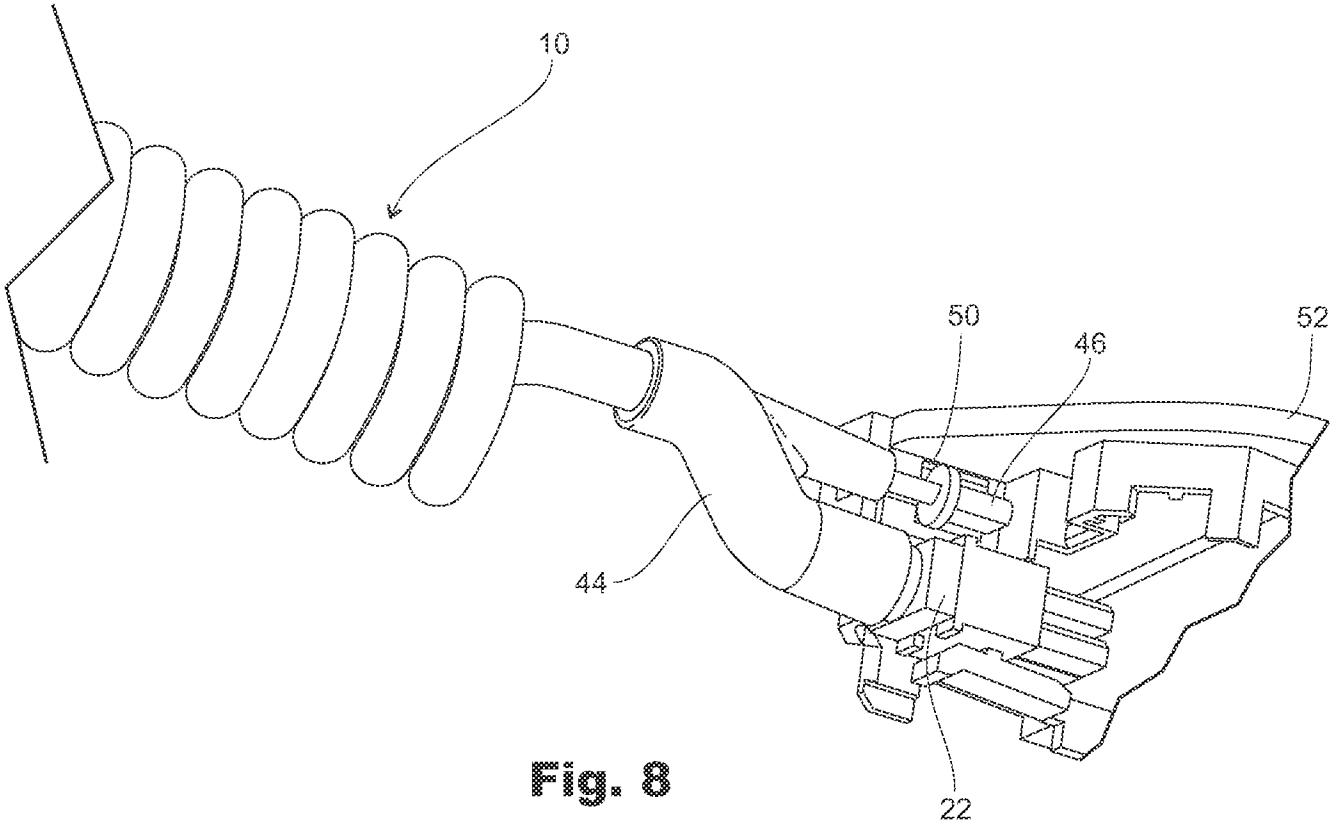
FIG. 8 is a pictorial view similar to FIG. 3, but shows how cord strain relief is implemented.
Figure 9:
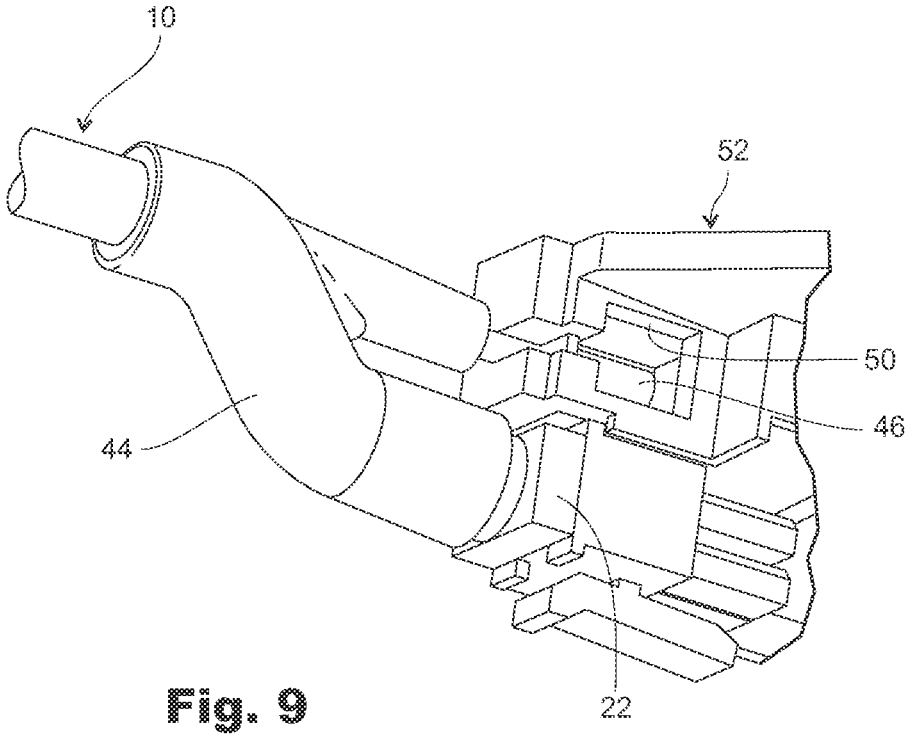
FIG. 9 is an enlargement of the pictorial view shown in FIG. 8 and illustrates how a strain-relief ferrule is captured in a fixture.
Figure 10:
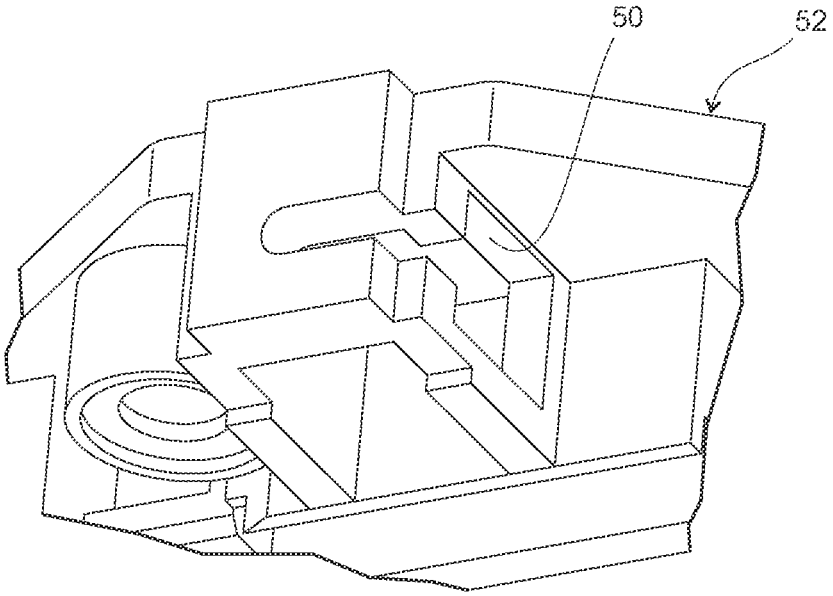
FIG. 10 is a view similar to FIG. 9, but with the strain-relief ferrule missing.

More specifically, and referring now to FIG. 8, the ferrule/washer combination 46, 48 are fit into a recess 50 in a housing 52 to which the cord 10 is connected. The recess 50 is better seen in FIG. 10.

Figure 3:
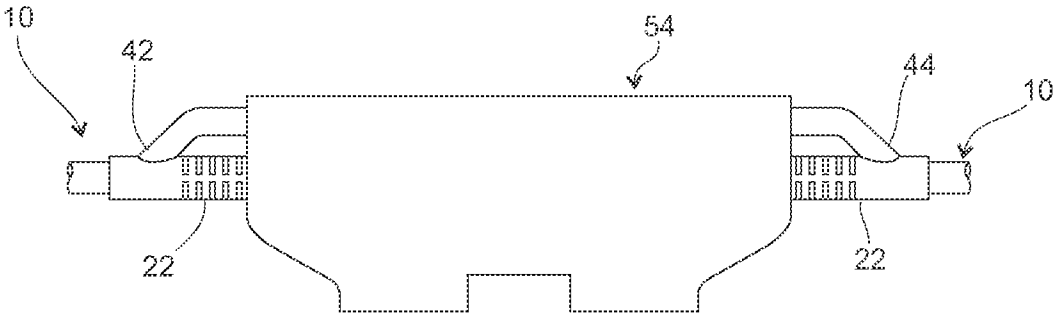
FIG. 3 is a side cross-sectional view, showing how the coiled power/security cord connects to a housing.
Figure 4:
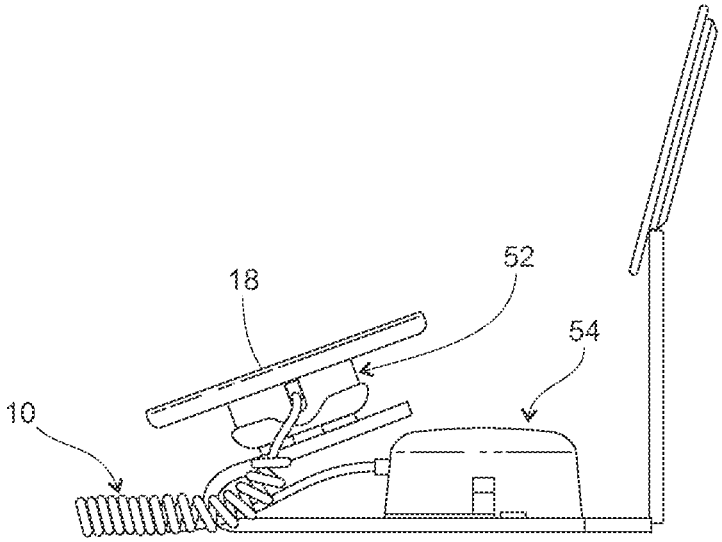
FIG. 4 is a side view showing a specific retail display where the coiled power/security cord might be used.
Figure 5:
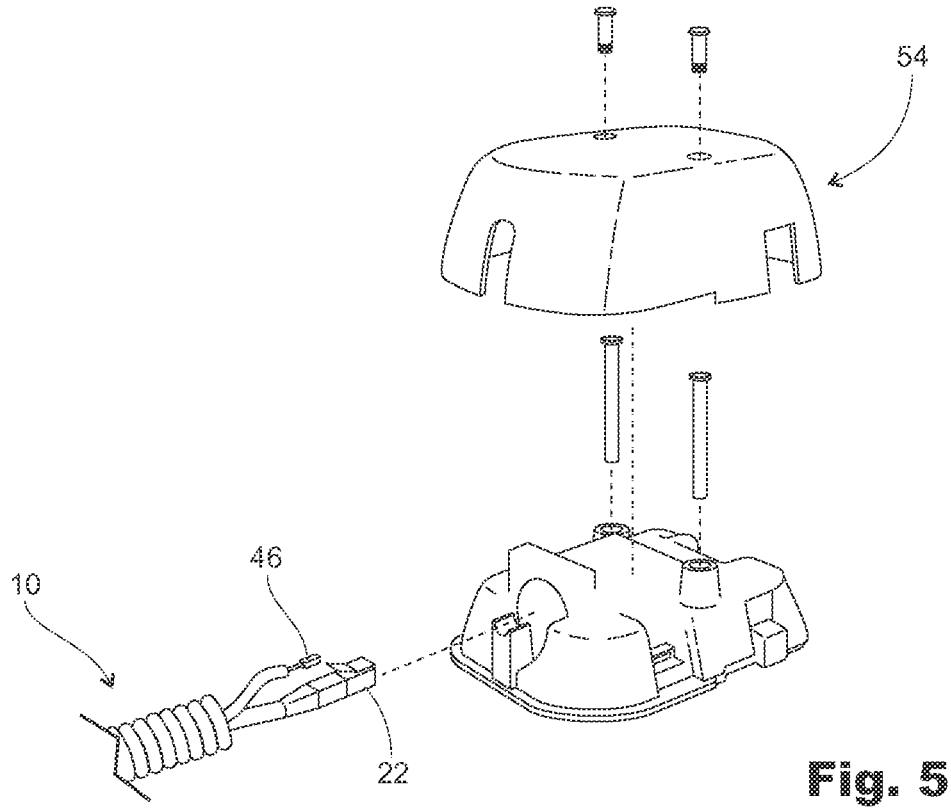
FIG. 5 is a view showing alternative uses of the coiled power/security cord.

The housing 52 might be the same as item 16 in FIG. 1 or it could be a different kind of mounting member like, for example, the surface anchor generally indicated at 54 in FIG. 5. FIG. 3 is a side view that shows how two cords 10 might plug into opposite sides of a housing 52. FIG. 4 shows yet another kind of display arrangement where the cord 10 could be used. In any case, the recess 50 captures the ferrule/washer combination 46, 48 and allows it to relieve any strain put on connector 22 during the course of pulling the cord 10 while the consumer examines the product 18.

Figure 7:
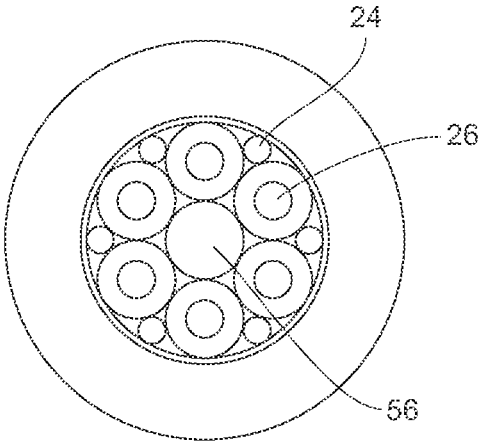
FIG. 7 is a view similar to FIG. 6, but shows yet another embodiment.

It is important to understand that at least one steel strand 24 is included in the cord 10 and at least one conductor 26. However, as reflected in FIG. 7, compared to FIG. 6, the numbers of steel strands 24 and conductors 26 can be a variable depending on the specific application and the desired balance between cut-resistance, flexibility, extension/retraction, and power requirements. In FIG. 7, for example, the steel strands 24 are arranged radially outwardly relative to the conductors 26. In this embodiment, the conductors 26 circle a central filler 56.

Figure 11:
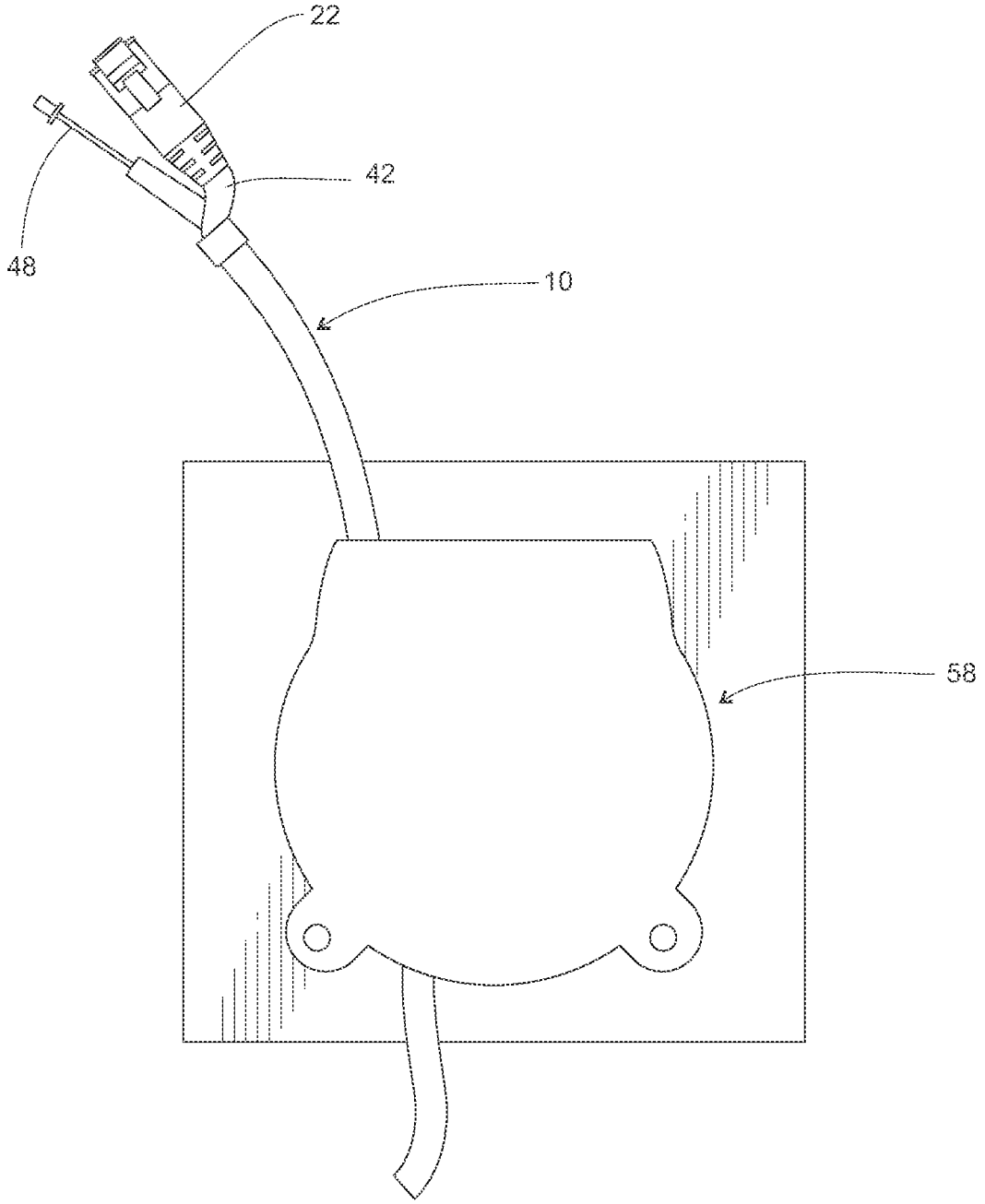
FIG. 11 is a schematic showing an alternative embodiment of the power/security cord described here, and illustrates how a non-coiled version of the cord may be used in connection with a reeled configuration.

To summarize, these embodiments enable the construction of a coiled cord for use as a power/security tether in retail displays. It is anticipated that the steel strands will be made of spring steel and coiled in the shape illustrated at 20 in FIG. 2. Alternatively, it is conceivable that braided steel strands may be used in combination with conductors or it is possible an arrangement of parallel steel strands and conductors could be used. These latter two examples might be suitable for using the cord "uncoiled" on a reel—with the reel providing extension and retraction of the tether. In other words, it is conceivable that a non-coiled version of cord 10 could be housed within a conventional reel structure, schematically indicated at 58 in FIG. 11, with the strain relief on the cord's end as described above. In such case, the cord 10 would simply reel and unreel in the same way as conventional "retractors," which are reel-based tether systems common in the art relating to retail security systems. The reel 58 schematically indicated in FIG. 11 is a common component in the retail security field and would be familiar to the skilled person. There are many examples of these kinds of reels illustrated in the patent literature.

The foregoing sets forth the best mode for carrying out the invention. Whether limited to coiled or non-coiled applications, it is to be understood that the scope of patent protection is not to be limited by the foregoing description. Instead, the scope of patent protection is to be limited only by the claim or claims that follow below.

What is claimed is:

1. An apparatus comprising:

a cord configured for connection with a mounting member for use in a retail display, the cord having a cord length that terminates at a first cord end portion and a second cord end portion, wherein the cord length includes a first non-coiled portion, a second non-coiled portion, and a coiled portion between the first and second non-coiled portions, wherein the cord length is extensible via the coiled portion in response to a pulling force, and wherein the coiled portion is terminated on each end by wire clips;

wherein the cord comprises (1) a conductor, (2) a mechanical cable, (3) a sheath that surrounds the conductor and the mechanical cable, (4) an electrical connector at the first cord end portion and configured for electrical connection with the mounting member, (5) a strain relief connector at the first cord end portion and configured for non-electrical connection with the mounting member, and (6) a molded fitting at the first cord end portion, wherein the molded fitting fits around the conductor and the mechanical cable and is shaped to provide branching that branches the strain relief connector away from the electrical connector;

wherein the conductor is formed from a first material;

wherein the conductor extends along the cord length such that the conductor includes a first non-coiled conductor portion, a second non-coiled conductor portion, and a coiled conductor portion between the first and second non-coiled conductor portions;

wherein the mechanical cable is formed from a second material, wherein the second material has a higher cut-resistance than the first material;

wherein the mechanical cable also extends along the cord length such that the mechanical cable includes a first non-coiled mechanical cable portion, a second non-coiled mechanical cable portion, and a coiled mechanical cable portion between the first and second non-coiled mechanical cable portions;

wherein a portion of the mechanical cable extends from the molded fitting, wherein the portion of the mechanical cable that extends from the molded fitting has an end that terminates at the strain relief connector to provide a non-electrical connection to the mounting member;

wherein the mechanical cable has an end that terminates at the strain relief connector to provide a non-electrical connection to the mounting member, wherein the cord is thereby independently connectable to the mounting member via both (1) the conductor and the electrical connector, and (2) the mechanical cable and the strain relief connector; and wherein the strain relief connector is adapted to provide strain relief for the electrical connector when the electrical connector and the strain relief connector are connected to the mounting member, and wherein the strain relief connector comprises a ferrule and washer fitting.

2. The apparatus of claim 1 wherein the second material comprises spring steel.

3. The apparatus of claim 2 wherein the electrical connection comprises a power connection.

4. The apparatus of claim 1 wherein the cord further comprises a plurality of the mechanical cables surrounded by the sheath.

5. The apparatus of claim 4 wherein the cord further comprises a plurality of the conductors surrounded by the sheath.

6. The apparatus of claim 5 wherein the mechanical cables and the conductors are interwoven together inside the sheath.

7. The apparatus of claim 5 wherein the mechanical cables and the conductors run longitudinally parallel to each other inside the sheath.

8. The apparatus of claim 5 wherein at least one of the conductors is positioned inside the sheath radially inward relative to a plurality of the mechanical cables.

9. The apparatus of claim 5 wherein the cord further comprises a central filler core inside the sheath, wherein the central filler core is positioned inside the sheath radially inward relative to the mechanical cables and the conductors.

10. The apparatus of claim 5 wherein the sheath comprises an exterior sheath and an interior sheath, wherein the exterior sheath surrounds the interior sheath, and wherein the interior sheath surrounds the mechanical cables and the conductors.

11. The apparatus of claim 1 wherein the cord further comprises (1) an electrical connector at the second cord end portion and configured for electrical connection with an anchor of the retail display, and (2) a strain relief connector at the second cord end portion and configured for non-electrical connection with the anchor;

wherein the conductor has another end that terminates at the electrical connector at the second cord end portion to provide an electrical connection to the anchor; and wherein the mechanical cable has another end that terminates at the strain relief connector at the second cord end portion to provide a non-electrical connection to the anchor.

12. The apparatus of claim 11 further comprising the mounting member and the anchor, wherein the cord is configured to tether the mounting member to the anchor, and wherein the mounting member is adapted to hold an electronic hand-held device for presentation to a customer.

13. The apparatus of claim 11 wherein the cord further comprises a second molded fitting at the second cord end portion;

wherein the second molded fitting is shaped to provide branching that branches the strain relief connector at the second cord end portion away from the electrical connector at the second cord end portion.

14. The apparatus of claim 1 wherein the second material comprises Kevlar.

15. The apparatus of claim 1 wherein the cord coiled portion, the coiled conductor portion, and the coiled mechanical cable portion are arranged in a Curly-Q configuration.

16. The apparatus of claim 1 wherein the conductor comprises electrical wire.

17. The apparatus of claim 1 further comprising the mounting member, wherein the mounting member is adapted to hold an electronic hand-held device for presentation to a customer, and wherein the mounting member includes a recess for receiving the strain relief connector.

18. The apparatus of claim 1 wherein the first and second non-coiled portions of the cord are flexible.

19. An apparatus comprising:

a cord configured for connection with a mounting member for use in a retail display, the cord having a cord length that terminates at a first cord end portion and a second cord end portion, wherein the cord length includes a first non-coiled portion, a second non-coiled portion, and a coiled portion between the first and second non-coiled portions, wherein the cord length is extensible via the coiled portion in response to a pulling force, and wherein the coiled portion is terminated on each end by wire clips;

wherein the cord comprises (1) a conductor, (2) a mechanical cable, (3) a sheath that surrounds the conductor and the mechanical cable, (4) an electrical connector at the first cord end portion and configured for electrical connection with the mounting member, (5) a strain relief connector at the first cord end portion and configured for non-electrical connection with the mounting member, and (6) a molded fitting at the first cord end portion, wherein the molded fitting fits around the conductor and the mechanical cable and is shaped to provide branching that branches the strain relief connector away from the electrical connector;

wherein the conductor extends along the cord length such that the conductor includes a first non-coiled conductor portion, a second non-coiled conductor portion, and a coiled conductor portion between the first and second non-coiled conductor portions;

wherein the mechanical cable is formed from spring steel or Kevlar;

wherein the mechanical cable also extends along the cord length such that the mechanical cable includes a first non-coiled mechanical cable portion, a second non-coiled mechanical cable portion, and a coiled mechanical cable portion between the first and second non-coiled mechanical cable portions;

wherein the conductor has an end that terminates at the electrical connector to provide an electrical connection to the mounting member;

wherein a portion of the mechanical cable extends from the molded fitting, wherein the portion of the mechanical cable that extends from the molded fitting has an end that terminates at the strain relief connector to provide a non-electrical connection to the mounting member, wherein the cord is thereby independently connectable to the mounting member via both (1) the conductor and the electrical connector, and (2) the mechanical cable and the strain relief connector; and wherein the strain relief connector is adapted to provide strain relief for the electrical connector when the electrical connector and the strain relief connector are connected to the mounting member, and wherein the strain relief connector comprises a ferrule and washer fitting.

20. The apparatus of claim 19 wherein the cord further comprises (1) a plurality of the mechanical cables surrounded by the sheath, and (2) a plurality of the conductors surrounded by the sheath, and wherein at least one of the conductors is positioned inside the sheath radially inward relative to a plurality of the mechanical cables.

21. The apparatus of claim 19 wherein the cord further comprises (1) an electrical connector at the second cord end portion and configured for electrical connection with an anchor of the retail display, and (2) a strain relief connector at the second cord end portion and configured for non-electrical connection with the anchor;

wherein the conductor has another end that terminates at the electrical connector at the second cord end portion to provide an electrical connection to the anchor; and wherein the mechanical cable has another end that terminates at the strain relief connector at the second cord end portion to provide a non-electrical connection to the anchor.

22. The apparatus of claim 21 wherein the cord further comprises a second molded fitting at the second cord end portion;

wherein the second molded fitting is shaped to provide branching that branches the strain relief connector at the second cord end portion away from the electrical connector at the second cord end portion.

* * * * *